US011224251B2

(12) United States Patent
Jordil et al.

(10) Patent No.: US 11,224,251 B2
(45) Date of Patent: Jan. 18, 2022

(54) AEROSOL-GENERATING ARTICLE COMPRISING A LIQUID DELIVERY ELEMENT

(71) Applicant: PHILIP MORRIS PRODUCTS S.A., Neuchatel (CH)

(72) Inventors: Yves Jordil, Lausanne (CH); Laurent Lavanant, Evian-les-Bains (FR)

(73) Assignee: Philip Morris Products S.A., Neuchatel (CH)

( * ) Notice: Subject to any disclaimer, the term of this patent is extended or adjusted under 35 U.S.C. 154(b) by 248 days.

(21) Appl. No.: 16/470,645

(22) PCT Filed: Dec. 21, 2017

(86) PCT No.: PCT/EP2017/084172
§ 371 (c)(1),
(2) Date: Jun. 18, 2019

(87) PCT Pub. No.: WO2018/122109
PCT Pub. Date: Jul. 5, 2018

(65) Prior Publication Data

US 2019/0373946 A1 Dec. 12, 2019

(30) Foreign Application Priority Data

Dec. 29, 2016 (EP) ..... 16207306

(51) Int. Cl.
*A24D 3/04* (2006.01)
*A24D 3/14* (2006.01)
(Continued)

(52) U.S. Cl.
CPC ..... *A24D 3/048* (2013.01); *A24D 3/14* (2013.01); *A24D 3/061* (2013.01); *A24D 3/18* (2013.01); *B65D 17/06* (2013.01)

(58) Field of Classification Search
None
See application file for complete search history.

(56) References Cited

U.S. PATENT DOCUMENTS 4,865,056 A * 9/1989 Tamaoki ..... B65D 17/06 131/337
4,889,144 A 12/1989 Tateno
(Continued)

FOREIGN PATENT DOCUMENTS

CN 102450741 5/2012
CN 102835735 12/2012
(Continued)

OTHER PUBLICATIONS

PCT Search Report and Written Opinion for PCT/EP2017/084172 dated Apr. 5, 2018 (9 pages).
(Continued)

*Primary Examiner* — Dennis R Cordray
(74) *Attorney, Agent, or Firm* — Mueting Raasch Group

(57) ABSTRACT

An aerosol-generating article (10) includes a mouthpiece (14) comprising at least one segment of filter material (18,20) and a liquid delivery element (22). The liquid delivery element (22) comprises: an upstream end and a downstream end; a double-walled annular body portion (28) comprising: an inner wall (34) defining a longitudinal channel (38) extending through the liquid delivery element (22); and an outer wall (32) integrally formed with the inner wall (34), the outer wall (32) circumscribing the inner wall (34) such that a cavity (36) is defined between the outer wall (32) and the inner wall (34), the cavity (36) having an opening in at least one of the upstream end and the downstream end and containing a liquid; and annular sealing means (40) inserted between the inner wall (34) and the outer wall (32) of the annular body portion (28) to provide a liquid tight seal at the opening or openings of the cavity (36). The inner wall (34)
(Continued)

and the outer wall (32) of the annular body portion (28) are configured such that the inner wall (34) is breakable upon application of a compressive force to the liquid delivery element (22) in a transverse direction and such that upon breakage of the inner wall (34) the liquid is released from the cavity (36) into the longitudinal channel (38).

15 Claims, 2 Drawing Sheets

(51) Int. Cl.

| | |
|---|---|
| *A24D 3/06* | (2006.01) |
| *A24D 3/18* | (2006.01) |
| *B65D 17/00* | (2006.01) |

(56) References Cited

U.S. PATENT DOCUMENTS

| | | | | |
|---|---|---|---|---|
| 9,516,895 | B2 * | 12/2016 | Awty | A24D 3/048 |
| 2015/0047658 | A1 | 2/2015 | Cyphert | |
| 2019/0000134 | A1 * | 1/2019 | Lavanant | A24D 3/061 |
| 2019/0014815 | A1 * | 1/2019 | Lavanant | A24D 3/061 |

FOREIGN PATENT DOCUMENTS

| | | |
|---|---|---|
| CN | 104379006 | 2/2015 |
| CN | 205390291 | 7/2016 |
| EP | 0276021 | 7/1988 |
| EP | 3072404 | 9/2016 |
| EP | 2835061 | 1/2019 |
| RU | 107025 | 8/2011 |
| WO | WO 2012/156689 | 11/2012 |
| WO | WO 2012/156694 | 11/2012 |
| WO | WO 2012/156698 | 11/2012 |
| WO | WO 2012/156703 | 11/2012 |
| WO | WO 2013/098957 | 7/2013 |
| WO | WO 2014/196369 | 5/2014 |
| WO | WO 2017/114727 | 12/2016 |
| WO | WO 2017/009298 | 1/2017 |

OTHER PUBLICATIONS

Office Action issued in China for Application No. 201780075257.5 dated Mar. 23, 2021 (12 pages). English translation included.

Office Action issued in Russia for Application No. 2019123431 dated Apr. 21, 2021 (12 pages). English translation included.

* cited by examiner

AEROSOL-GENERATING ARTICLE COMPRISING A LIQUID DELIVERY ELEMENT

This application is a U.S. National Stage Application of International Application No. PCT/EP2017/084172 filed Dec. 21, 2017, which was published in English on Jul. 5, 2018, as International Publication No. WO 2018/122109 A1. International Application No. PCT/EP2017/084172 priority to European Application No. 16207306.8 filed Dec. 29, 2016.

The present invention relates to an aerosol-generating article comprising a novel liquid delivery element. The invention finds particular application as an elongate smoking article, such as a cigarette.

Smoking articles, such as cigarettes, typically comprise an aerosol-generating substrate, such as a tobacco rod, attached to a mouthpiece. Conventional mouthpieces comprise one or more segments of a filtration material such as cellulose acetate tow. In some cases, it may be desirable to provide a liquid within the filtration material to alter a taste sensation experienced by a consumer during smoking of the smoking article. For example, it may be desirable to provide water or a liquid flavourant within the filtration material. However, liquids deposited directly onto the filtration material during manufacture of the smoking article may escape during storage and cause staining of other components of the smoking article, or the packaging. Volatile liquids deposited directly onto the filtration material during manufacture may escape the smoking article and the package entirely.

Some attempts to reduce or eliminate the leakage or escape of liquids from the mouthpieces of smoking articles use a container positioned within the mouthpiece and in which the liquid is contained until a consumer releases the liquid from the container, either immediately before or during smoking of the smoking article. For example, EP-0276021-A2 describes a cigarette comprising a breakable plastic capsule situated in the vicinity of a filter member, the breakable plastic capsule containing a fluid material. However, the breakable plastic capsule described in EP-0276021-A2 is combined with additional components, such as a corrugated sheet wrapped around the breakable plastic capsule, to form smoke passages around the breakable plastic capsule. The cigarettes described in EP-0276021-A2 are therefore complex to manufacture, requiring the registration and assembly of multiple components to form the filter section of each cigarette.

It would be desirable to provide an aerosol-generating article that overcomes the disadvantages associated with known smoking articles. In particular, it would be desirable to provide an aerosol-generating article that includes novel means for delivering a liquid to a segment of filter material whilst enabling a desirable resistance to draw to be maintained through the article. It would further be desirable to provide such a means for delivering a liquid which can be readily and reliably manufactured and which securely stores the liquid prior to use. It would be particularly desirable to provide such a means for delivering a liquid which can be readily incorporated into existing filter constructions such that the filters can be manufactured with minimal modification to existing high speed manufacturing machines and processes.

According to the invention there is provided an aerosol-generating article comprising an aerosol-generating substrate and a mouthpiece secured to a downstream end of the aerosol-generating substrate, the mouthpiece comprising at least one segment of filter material and a liquid delivery element. The liquid delivery element comprises: an upstream end and a downstream end; and a double-walled annular body portion comprising: an inner wall defining a longitudinal channel extending through the liquid delivery element between the upstream end and the downstream end; and an outer wall integrally formed with the inner wall, the outer wall circumscribing the inner wall such that a cavity is defined between the outer wall and the inner wall, the cavity having an opening in at least one of the upstream end and the downstream end and containing a liquid. The liquid delivery element further comprises annular sealing means inserted between the inner wall and the outer wall of the annular body portion to provide a liquid tight seal at the opening or openings of the cavity in the annular body portion. The inner wall and the outer wall of the annular body portion are configured such that the inner wall is breakable upon application of a compressive force to the liquid delivery element in a transverse direction and such that upon breakage of the inner wall the liquid is released from the cavity into the longitudinal channel.

According to the invention there is further provided a liquid delivery element for use in a consumer article, the liquid delivery element comprising: a first end and a second end; and a double-walled annular body portion comprising: an inner wall defining a longitudinal channel extending through the liquid delivery element between the first end and the second end; and an outer wall integrally formed with the inner wall, the outer wall circumscribing the inner wall such that a cavity is defined between the outer wall and the inner wall, the cavity having an opening in at least one of the first end and the second end and containing a liquid. The liquid delivery element further comprises annular sealing means inserted between the inner wall and the outer wall of the annular body portion to provide a liquid tight seal at the opening or openings of the cavity in the annular body portion. The inner wall and the outer wall of the annular body portion are configured such that the inner wall is breakable upon application of a compressive force to the liquid delivery element in a transverse direction and such that upon breakage of the inner wall the liquid is released from the cavity into the longitudinal channel.

As used herein, the term "liquid delivery element" refers to a discrete mouthpiece element for the storage and delivery of a liquid within the mouthpiece. The liquid delivery element of the present invention comprises a double-walled annular body portion sealed by annular sealing means and is configured to be activated by the consumer. The present invention therefore provides a novel means for the delivery of a liquid within a filter that is distinct from the known capsules and other delivery devices of the prior art.

As used herein, the terms "upstream" and "downstream" describe the relative positions of elements, or portions of elements, of the aerosol-generating article in relation to the direction in which a consumer draws on the aerosol-generating article during use thereof. Aerosol-generating articles as described herein comprise a downstream end, corresponding to the mouth end, and an opposed upstream end. In use, a consumer draws on the downstream end of the aerosol-generating article. The downstream end is downstream of the upstream end, which may also be described as the distal end.

As used herein, the term "aerosol-generating substrate" is used to describe a substrate capable of releasing, upon heating, volatile compounds, which can form an aerosol. The aerosol generated from aerosol-generating substrates may be visible or invisible and may include vapours (for example, fine particles of substances, which are in a gaseous state, that are ordinarily liquid or solid at room temperature) as well as gases and liquid droplets of condensed vapours.

By providing a liquid within a cavity of a liquid delivery element, aerosol-generating articles according to the present invention can reduce or prevent escape of the liquid from the aerosol-generating article during storage. The liquid is securely stored within the cavity defined within the double-walled structure of the annular body portion and the annular sealing means provides a strong liquid tight seal at one or both ends of the cavity so that the liquid is securely retained within the cavity until the consumer chooses to deliver the liquid from the liquid delivery element to the filter material.

The double-walled structure of the annular body portion can be integrally formed in a single component, which reduces the complexity of manufacture and assembly. The use of an integral structure also reduces the number of connecting components required for the liquid delivery element which in turn minimises the likelihood of leakages between components. The cavity can be readily filled through an opening provided between the inner and outer walls of the annular body portion, after which the annular sealing means can be inserted to close the opening and provide a liquid tight seal.

The provision of liquid within a cavity of a liquid delivery element provides the consumer with a choice over when to deliver the liquid from the liquid delivery element to the at least one segment of filter material. For example, a consumer may choose to deliver the liquid to the at least one segment of filter material immediately before smoking the aerosol-generating article, or during smoking of the aerosol-generating article. Alternatively, a consumer may choose to smoke the aerosol-generating article without delivering the liquid from the liquid delivery element to the at least one segment of filter material.

The liquid delivery element comprises a longitudinal channel extending between the upstream and downstream ends of the liquid delivery element, wherein the longitudinal channel is open to allow aerosol to pass through the liquid delivery element. Aerosol-generating articles according to the present invention can therefore incorporate the liquid delivery element into the mouthpiece and maintain a resistance to draw that is similar to, or lower than, the resistance to draw of a corresponding aerosol-generating article that does not include a liquid delivery element, such as a conventional filter cigarette.

Furthermore, by forming the longitudinal channel as an integral part of the liquid delivery element that extends between the upstream and downstream ends, aerosol-generating articles according to the present invention can be manufactured using existing high speed manufacturing machines and processes with minimal modification. In particular, the liquid delivery element can be combined with other mouthpiece segments, such as the at least one segment of filter material, using a conventional combining process.

As defined above, the aerosol-generating article according to the present invention incorporates a novel liquid delivery element having a cavity defined between the inner and outer walls of the annular body portion, which contains a liquid. Prior to the activation of the liquid delivery element, the liquid remains held within the cavity and the open longitudinal channel defined by the inner wall extends all of the way through the liquid delivery element to provide an airflow pathway through which aerosol can be drawn during smoking of the aerosol-generating article.

As used herein, the term "activate" refers to an action that causes the liquid delivery element to deliver the liquid from the cavity into the longitudinal channel, from where it can pass into the at least one segment of filter material. In the context of the present invention, activation is brought about by application of a compressive force to the liquid delivery element in a transverse direction to break the inner wall. The force is applied in a transverse direction to the inner surface, which will typically be substantially perpendicular to the longitudinal axis. To activate the liquid delivery element, the outer wall must be squeezed and deformed by the consumer to a sufficient extent that the compressive force causes the inner wall to break. Upon breakage of the inner wall, the liquid is released from the cavity through one or more liquid pathways set up in the gaps created in the broken inner wall, directly into the longitudinal channel.

The consumer therefore has control over the delivery of the liquid to the at least one segment of filter material. The liquid delivery element may be configured such that the liquid is substantially all released from the cavity upon initial breakage of the frangible core element. Alternatively, the liquid delivery element may be configured such that the consumer may choose to deliver only some of the liquid from the cavity, with the remainder of the liquid remaining in the cavity for one or more subsequent deliveries.

Advantageously, the consumer is able to feel when the inner wall of the annular body portion has broken to activate the liquid delivery element and can therefore apply only the required degree of compression, thereby avoiding damage to the mouthpiece as a result of excessive compressive force. Alternatively or in addition, the breakage of the inner wall of the annular body portion may produce an audible sound such that the consumer can hear when the liquid delivery element has been activated.

The inner wall preferably cracks, fractures or snaps under an applied force rather than shattering, such that the inner wall does not break apart but retains its structural integrity as far as possible after activation.

As described above, the annular body portion of the liquid delivery element is a double-walled structure which is integrally formed to provide an annular inner wall and an annular outer wall. The outer wall is radially spaced apart from the inner wall to define a cavity between the inner and outer walls. The cavity extends around the outside of the inner wall and will typically also be annular. The spacing between the inner wall and the outer wall can be adjusted in order to alter the volume of cavity as desired.

The liquid delivery element is preferably arranged such that the normal to the inner surface of the annular body portion is substantially perpendicular to the longitudinal axis of the aerosol-generating article.

Preferably, the spacing between the inner wall and the outer wall is substantially constant along the length of the cavity. However, in some embodiments at least one of the outer surface of the inner wall and the inner surface of the outer wall may be modified such that the spacing between the inner wall and the outer wall varies along the length of the cavity. The cavity will therefore be asymmetric along its length, with a greater proportion of the liquid at one end of the cavity than the other. Such a configuration may be used to control the directionality of the liquid release from the cavity. For example, it may be desirable to provide a preferential delivery of the liquid in one axial direction towards a filter segment on one side of the liquid delivery element.

Preferably, the maximum radial spacing of the inner wall and the outer wall is less than about 1 mm, more preferably less than about 0.8 mm. Alternatively or in addition, the maximum radial spacing of the inner wall and the outer wall is at least about 0.4 mm, more preferably at least about 0.6 mm.

An opening is provided in at least one end of the annular body portion, between the inner wall and the outer wall, to enable liquid to be inserted into the cavity. Preferably, the inner wall and the outer wall are integrally connected to each other at one end of the annular body portion and an opening in the cavity is provided at the other end of the annular body portion. Only one annular sealing means is therefore necessary in order to provide a liquid tight seal to the cavity. The inner wall and the outer wall of the annular body portion are configured in such a way that the inner wall breaks when a transverse compressive force is applied to the liquid delivery element. The outer wall therefore needs to be sufficiently deformable or flexible that the compressive force applied to the liquid delivery element is transferred to the inner wall to provide sufficient force on the inner wall that breakage occurs. In some embodiments, at least a portion of the outer wall is sufficiently flexible that the consumer can make contact with the inner wall in order to break it. In other embodiments, in particular where the cavity is full or close to full with liquid, the outer wall only needs to be flexible enough to allow a sufficient force to be transmitted to the inner wall through the liquid in the cavity.

In order to enable the applied compressive force to be effectively transmitted to the inner wall so that the inner wall can be broken to activate the liquid delivery element, it is preferable that the inner wall breaks before the outer wall upon application of a transverse compressive force to the liquid delivery element. In such embodiments, the outer wall preferably does not break at all during normal activation of the liquid delivery element and therefore remains intact. Alternatively, an effective release of the liquid in the cavity may be possible where the outer wall breaks at substantially the same time as the inner wall.

In order to provide a configuration such that the inner wall breaks preferentially, the distance at breakage of the inner wall is preferably smaller than the distance at breakage of the outer wall.

As used herein, the term "distance at breakage" refers to the change in the transverse dimension of the liquid delivery element due to compression, at the point of breakage. This also corresponds to the transverse deformation of the liquid delivery element at breakage. The distance at breakage of the inner wall therefore corresponds to the transverse deformation of the liquid delivery element at the point of breakage of the inner wall. Similarly, the distance at breakage of the outer wall corresponds to the transverse deformation of the liquid delivery element at the point of breakage of the outer wall.

The "force at breakage" of the inner wall corresponds to the maximum compressive force that the annular body portion can withstand before breakage of the inner wall. This corresponds to the compressive force required to activate the liquid delivery element.

In order to determine the force at breakage and the distance at breakage of the inner wall and the outer wall, the liquid delivery element can be tested in an automatic or manual compression testing machine, in which the liquid delivery element is compressed in a transverse direction, between a lower and upper compression plate. The compression plates are moved gradually towards each other to increase the compressive force until breakage of the wall occurs. The applied force in Newtons at the point of breakage of the wall corresponds to the "force at breakage" of that wall and the deformation in millimetres of the liquid delivery element in the transverse direction corresponds to the distance at breakage. Compression testing machines are well known in the art and are commercially available. A suitable examples of a compression testing machine is the FMI-220C2 Digital Force Gauge supplied by Alluris GmbH & Co.

Preferably, the distance at breakage of the inner wall corresponds to no more than about 50 percent of the external diameter of the liquid delivery element, preferably no more than about 40 percent. This means that the liquid delivery element is preferably deformed by no more than 50 percent prior to breakage of the inner wall. Alternatively or in addition, the distance at breakage of the inner wall preferably corresponds to at least about 20 percent of the external diameter of the liquid delivery element, more preferably at least 25 percent.

Preferably, the distance at breakage of the inner wall is between about 1.5 mm and about 3.5 mm, more preferably between about 1.8 mm and about 2.5 mm.

Preferably, the distance at breakage of the inner wall is at least about 1 mm smaller than the distance at breakage of the outer wall, more preferably at least about 2 mm smaller. Preferably, the force at breakage of the inner wall is between about 25 Newtons and about 80 Newtons, preferably between about 30 Newtons to about 60 Newtons, and more preferably between about 30 Newtons and about 45 Newtons.

There are a variety of different ways to configure the inner wall and the outer wall in order to provide the difference in the distance at breakage as defined above. For example, the radial thickness of the inner wall may be greater than the radial thickness of the outer wall at all positions along the length of the cavity, in order to make the outer wall more flexible and the inner wall more brittle. In this case, the radial thickness of the inner wall is preferably at least twice the radial thickness of the outer wall at all positions along the length of the cavity.

Preferably, the radial thickness of the inner wall is between about 0.3 mm and about 0.7 mm at all positions along the length of the cavity, more preferably between about 0.4 mm and about 0.6 mm. Preferably, the radial thickness of the outer wall is between about 0.1 mm and about 0.4 mm at all positions along the length of the cavity, more preferably between about 0.1 mm and about 0.3 mm. The radial thickness of the inner wall and the outer wall are preferably selected from within these ranges in order to provide the desired ratio of the thicknesses, as discussed above. For each of the inner wall and the outer wall, the radial thickness may be substantially constant along the length of the cavity or the radial thickness may vary along the length of the cavity.

Alternatively or in addition, the inner wall of the annular body portion may comprise one or more grooves in the inner or outer surface, in which the radial thickness of the inner wall is reduced. This provides points of weakness along the inner wall, at which the inner wall will break more easily upon the application of a transverse compressive force. The use of grooves in the inner wall of the annular body portion may be particularly effective when the inner wall has an increased radial thickness compared to the inner wall and is therefore relatively stiff.

As described above, the liquid provided within the liquid delivery element is retained within the cavity defined between the inner wall and the outer wall of the annular body portion. Preferably, the cavity is substantially filled by the liquid. Preferably, the volume of air within the cavity is less than about 5 percent of the total internal volume of the cavity in order to minimise the appearance of air bubbles within the liquid, in particular, where the annular body portion is substantially transparent as described below.

Preferably, the cavity contains no more than about 150 microlitres of liquid, particularly preferably no more than about 140 microlitres of liquid. Alternatively or in addition, the cavity preferably contains at least about 50 microlitres of liquid. Where the cavity is substantially filled by the liquid, the volume of liquid will also correspond approximately to the total volume of the cavity.

In any of the embodiments described above, the liquid within the cavity of the liquid delivery element may comprise water. The liquid may consist essentially of water.

Alternatively, the liquid may comprise one or more components in addition to water, or as an alternative to water. In those embodiments in which the liquid comprises one or more components in addition to water, each of the additional components may be dissolved in the water or suspended within the water. Preferably, the liquid is a hydrophilic or lipophilic liquid.

In some embodiments the liquid may comprise at least one flavourant, preferably a hydrophilic flavourant. Suitable flavourants include acetoin, sucrose, sorbitol, ethyl lactate, citric acid, chicory extract, alpha ionone, lactic acid, pyruvic acid, vanilla oleoresin, butyl alcohol, butyric acid, benzyl alcohol, ethyl acetate, fenugreek extract, isobutyl alcohol, isobutyric acid, cyclotene, coffee dione, frambinone, 2-3 dimethyl pyrazine, ethyl butyrate, ethyl maltol, ethyl propionate, vanillin, furaneol, isobutyraldehyde, isovaleric acid, maltol, benzaldehyde, dimethyl sulphide, 2 methyl butyric acid, isovaleraldehyde, phenethyl alcohol, phenylacetic acid, heliotropine, valeric acid, valeraldehyde, and combinations thereof.

Additionally, or alternatively, the liquid may comprise at least one humectant. Suitable humectants include glycerol, malitol, xylitol, sorbitol, polyethylene glycol, triethylene glycol, butylene glycol, glycerin, polydextrose, and combinations thereof.

In any of the embodiments described above, the liquid may be substantially colourless.

Alternatively, the liquid may be coloured. Coloured liquids may be preferable in those embodiments in which the deformable outer container is formed from a substantially transparent material so that the coloured liquid is visible.

The longitudinal channel defined by the inner wall of the annular body portion extends between the upstream end and the downstream end of the liquid delivery element and provides a longitudinal air flow channel through the liquid delivery element. The longitudinal channel is therefore open to allow for the unimpeded flow of aerosol through the liquid delivery element. As such, the longitudinal channel is substantially unfilled and free from solid or liquid materials. Preferably, the diameter of the longitudinal channel of the frangible core element is between about 2 millimetres and about 6 millimetres, more preferably between about 3.5 millimetres and about 5 millimetres.

Alternatively or in addition, the transverse cross-sectional area of the longitudinal channel is preferably between about 5 square millimetre and about 25 square millimetres, more preferably between about 10 square millimetre and about 20 square millimetres.

Additionally or alternatively, the length of the longitudinal channel is preferably between about 10 millimetres and about 14 millimetres, preferably about 12 millimetres.

The longitudinal channel may have any suitable cross-sectional shape. In some embodiments, the longitudinal channel has a substantially square or rectangular cross-sectional shape. Preferably, the longitudinal channel has a substantially circular cross-sectional shape.

The dimensions of the longitudinal channel may be configured in order to provide the desired resistance to draw of the aerosol-generating article.

The longitudinal channel is preferably configured so that the aerosol-generating article has a resistance to draw of between about 50 millimetres of water gauge and about 130 millimetres of water gauge, more preferably between about 70 millimetres of water gauge and 110 millimetres of water gauge, before the liquid is delivered from the liquid delivery element into the at least one segment of filter material. The resistance to draw of aerosol-generating articles according to the present invention may be substantially the same as, or similar to, the resistance to draw of otherwise identical aerosol-generating articles in which the liquid delivery element is replaced with a segment of filter material.

As used herein, the term "resistance to draw" refers to the pressure required to force air through the full length of the object under test at the rate of 17.5 millilitres per second at 22 degrees Celsius and 101 kilopascals (760 Torr). Resistance to draw is expressed in units of millimetres water gauge (mmWG) and is measured in accordance with ISO 6565:2011.

The annular body portion is preferably formed in a single part. The annular body portion is preferably formed of a polymeric material. Suitable polymer materials include polyethylene terephthalate, high density polyethylene, low density polyethylene, polycarbonates, Accura® 60 plastic (available from 3D Systems), WaterShed® XC 11122 (available from DSM Somos) and combinations thereof. The polymer may be injection moulded or extruded to form the annular body portion.

The polymeric material forming the annular body portion preferably has an elongation at break of between about 5 percent and about 20 percent when measured according to the test method of ASTM D 638, more preferably between about 5 percent and about 15 percent.

Alternatively or in addition, the polymeric material forming the annular body portion preferably has a flexural strength of between about 80 MPa and about 110 MPa when measured according to the test method of ASTM D 790, more preferably between about 85 MPa and about 100 MPa.

Alternatively or in addition, the polymeric material forming the annular body portion preferably has a flexural modulus of between about 2500 MPa and about 3500 MPa when measured according to the test method of ASTM D 790, more preferably between about 2700 MPa and about 3000 MPa.

The annular body portion may be formed of a substantially transparent material. The term "substantially transparent" is used to describe a material which allows at least a significant proportion of incident light to pass through it, so that it is possible to see through the material. In the present invention, a substantially transparent annular body portion may allow sufficient light to pass through it so that the liquid within the cavity is visible before activation of the liquid delivery element. Where the liquid within the cavity is also transparent, a substantially transparent annular body portion may also allow the smoke or one or more other aerosols generated by the aerosol-generating substrate and passing through the longitudinal channel during smoking of the aerosol-generating article to be visible.

The annular body portion may be completely transparent. Alternatively, the annular body portion may have a lower level of transparency while still transmitting sufficient light that at least one of the smoke or one or more other aerosols and the liquid are visible.

In those embodiments in which the annular body portion is substantially transparent, preferably any materials overlying the annular body portion are formed from a substantially transparent material, or comprise one or more apertures so that a portion of the liquid delivery element is visible through the one or more apertures.

Optionally, the material forming the annular body portion may be coloured or tinted.

The liquid delivery element of aerosol-generating articles according to the present invention further comprises annular sealing means provided at the opening or openings of the cavity in the annular body portion to provide a liquid tight seal to the cavity. The annular sealing means are configured to be inserted between the inner wall and the outer wall to seal the space between them. The annular form of the sealing means ensures that the longitudinal channel can be retained between the upstream and downstream ends of the liquid delivery element so that airflow through the liquid delivery element is not impeded.

Where the cavity is open at both ends, separate annular sealing means will typically be provided to seal each opening. In preferred embodiments in which only one end of the annular body portion is open, only a single annular sealing means is required at one end of the annular body portion.

The annular sealing means is preferably adapted to provide a liquid tight seal by means of a mechanical friction fit. However, in certain embodiments it may be desirable to use an adhesive to seal the annular sealing means in place between the inner and outer walls.

Preferably, the annular sealing means is in the form of a stopper that has an annular wall that is inserted between the inner wall and the outer wall of the annular body portion. Preferably, the annular wall of the stopper is resilient to enable insertion of the annular wall between the inner and outer walls whilst ensuring a secure friction fit. Particularly preferably, the stopper has a double walled structure having a first, outer wall received between the inner wall and the outer wall of the annular body portion and a second, inner wall received against the inner surface of the inner wall of the annular body portion. This configuration optimises the friction fit of the stopper within the annular body portion.

Preferably, the stopper comprises a flange or shoulder to limit the insertion of the stopper into the cavity. For example, the stopper may comprise an annular flange or shoulder on the outer surface which abuts the end of the inner wall or the outer wall of the annular body portion once the stopper is in place, to prevent further movement of the stopper into the cavity.

Preferably, the outer diameter of the stopper is substantially the same as the outer diameter of the annular body portion so that a uniform outer surface is provided on the liquid delivery element.

The stopper is preferably formed in a single part. The stopper is preferably formed of a polymeric material. Suitable polymer materials include vacuum casting resin 9070 (available from SLM Solutions GmbH). The polymer may be injection moulded or extruded to form the stopper.

The liquid delivery element comprising the annular body portion and the annular sealing means may have any suitable outer cross-sectional shape. Preferably, the liquid delivery element is substantially cylindrical and particularly preferably, the liquid delivery element is substantially cylindrical with a substantially circular cross-sectional shape. In preferred embodiments, the liquid delivery element has an outer diameter which substantially corresponds to the outer diameter of the at least one segment of filter material. This facilitates the combination and wrapping of the liquid delivery element with the other filter segments and enables manufacture of the mouthpiece and aerosol-generating article using existing high speed combining machines and processes.

In certain embodiments of the invention, the liquid delivery element may be circumscribed by a wrapper, such as a plug wrap, or by an annular layer of filtration material. In other embodiments, the liquid delivery element may be supported within a hollow tube, such as a hollow acetate tube, or a paper or cardboard tube. Alternatively, the liquid delivery element may be circumscribed only by the wrapper or wrapper combining the liquid delivery element with the other filter segments.

The length of the liquid delivery element is preferably between about 8 millimetres and about 15 millimetres, more preferably between about 10 millimetres and about 12 millimetres.

The mouthpiece of aerosol-generating articles according to the invention further comprises at least one segment of filter material. The at least one segment of filter material may comprise a downstream filter segment positioned downstream of the liquid delivery element.

When the downstream filter segment forms a mouth end of the aerosol-generating article, the downstream filter segment can advantageously provide a desirable mouth feel for the consumer that resembles the mouth feel of a conventional aerosol-generating article.

Additionally, or alternatively, the at least one segment of filter material may comprise an upstream filter segment positioned upstream of the liquid delivery element.

Preferably, the at least one filter segment comprises at least one upstream filter segment and at least one downstream filter segment, wherein the liquid delivery element is positioned between the at least one upstream filter segment and the at least one downstream filter segment.

Preferably, the filtration material within each filter segment is a plug of fibrous filtration material, such as cellulose acetate tow, polylactide or paper. A filter plasticiser may be applied to the fibrous filtration material in a conventional manner, by spraying it onto the separated fibres, preferably before any particulate material is applied to the filtration material.

The mouthpiece of aerosol-generating articles according to the invention may comprise a plug wrap circumscribing the liquid delivery element, as discussed above. The plug wrap may circumscribe only the liquid delivery element. Alternatively, the plug wrap may be a combining plug wrap circumscribing the liquid delivery element and the at least one segment of filter material. Preferably, at least one surface of the plug wrap is coated with an anti-staining coating to prevent leakage of the liquid through the plug wrap after it has been delivered from the cavity to the at least one segment of filter material. Suitable anti-staining coatings include ethyl cellulose and cellulose acetate.

The mouthpiece of aerosol-generating article according to the invention may further comprise a tipping wrapper. In preferred embodiments in which the flexible wall of the deformable outer container of the liquid delivery element is formed from a substantially transparent material, as described above, the aerosol-generating article preferably comprises a substantially transparent plug wrap overlying at least a portion of the liquid delivery element, and a tipping wrapper comprising at least one aperture at least partially overlying the substantially transparent wrapper and the liquid delivery element. This enables the liquid delivery element and the liquid within the cavity to be viewed from the exterior of the mouthpiece.

Aerosol-generating articles according to the present invention may be filter cigarettes or other aerosol-generating articles in which the aerosol-generating substrate comprises a tobacco material that is combusted to form smoke. Therefore, in any of the embodiments described above, the aerosol-generating substrate may comprise a tobacco rod.

Alternatively, aerosol-generating articles according to the present invention may be articles in which a tobacco material is heated to form an aerosol, rather than combusted. In one type of heated aerosol-generating article, a tobacco material is heated by one or more electrical heating elements to produce an aerosol. In another type of heated aerosol-generating article, an aerosol is produced by the transfer of heat from a combustible or chemical heat source to a physically separate tobacco material, which may be located within, around or downstream of the heat source. The present invention further encompasses aerosol-generating articles in which a nicotine-containing aerosol is generated from a tobacco material, tobacco extract, or other nicotine source, without combustion, and in some cases without heating, for example through a chemical reaction.

The invention will now be further described, by way of example only, with reference to the accompanying drawings in which.

Figure 1:
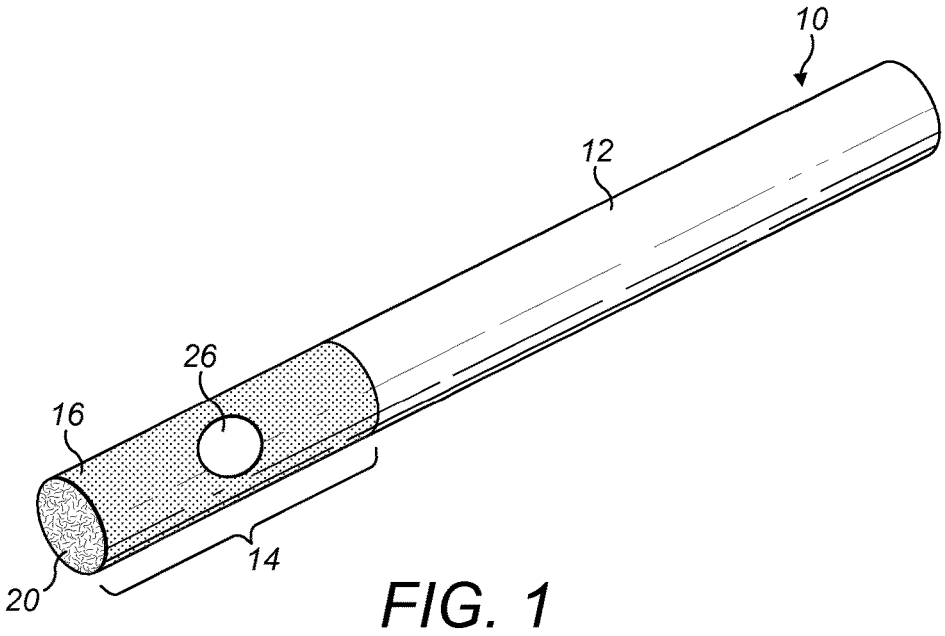
FIG. 1 shows a perspective view of an aerosol-generating article in accordance with the present invention.

FIG. 1 shows an aerosol-generating article 10 according to an embodiment of the present invention. The aerosol-generating article 10 is a filter cigarette comprising an aerosol-generating substrate 12 in the form of a wrapped tobacco rod, and a mouthpiece 14. The mouthpiece 14 is secured to the wrapped tobacco rod by a tipping wrapper 16.

Figure 2:
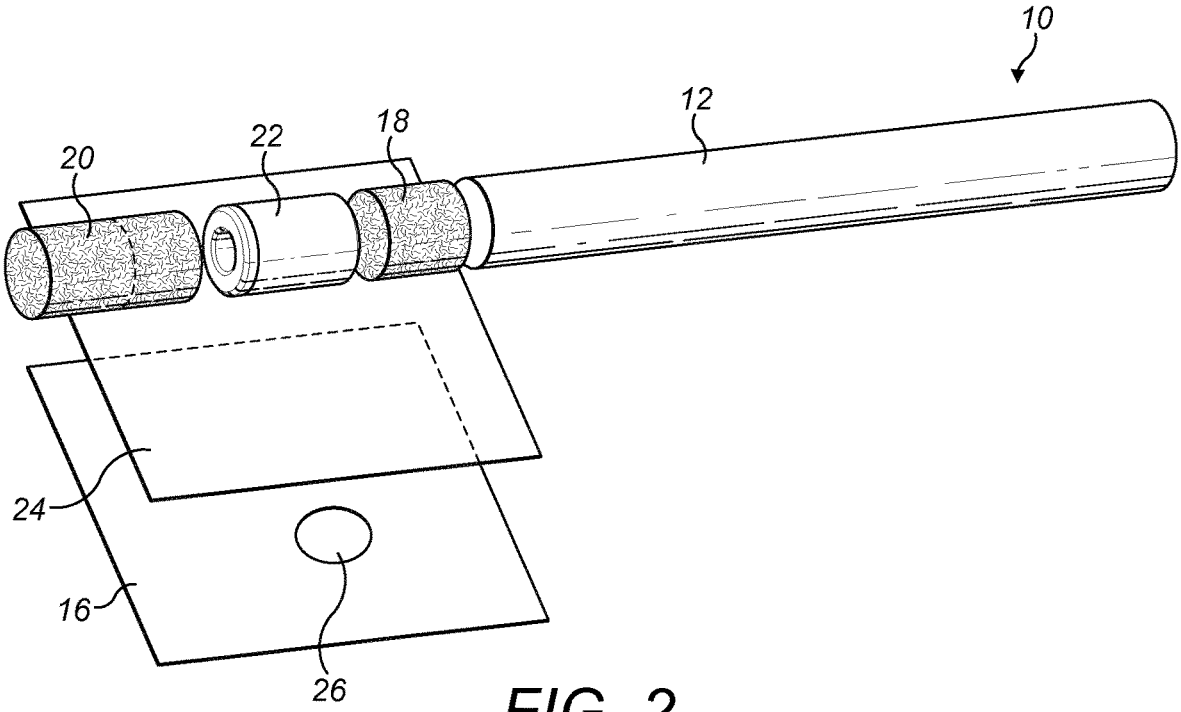
FIG. 2 shows an exploded view of the aerosol-generating article of FIG. 1, with the filter wrappers unwrapped.

As shown in FIG. 2, the mouthpiece 14 comprises an upstream filter segment 18 at an upstream end of the mouthpiece 14 and a downstream filter segment 20 at a downstream end of the mouthpiece 14. The mouthpiece 14 further comprises a liquid delivery element 22 positioned between the upstream and downstream filter segments 18, 20. A substantially transparent combining plug wrap 24 is wrapped around the upstream 18 and downstream 20 filter segments and the liquid delivery element 22 to combine them and form the mouthpiece 14. The tipping wrapper 16 comprises an aperture 26 overlying the liquid delivery element 22 and the substantially transparent plug wrap 24 so that the consumer can observe the liquid delivery element 22.

Figure 3:
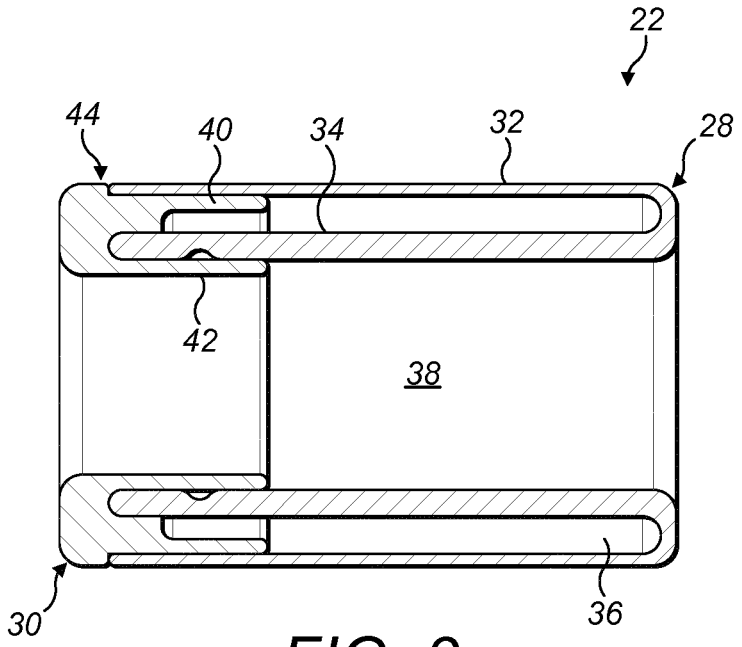
FIG. 3 shows a cross-sectional view of the liquid delivery element of the aerosol-generating article of FIG. 1, prior to activation.
Figure 4:
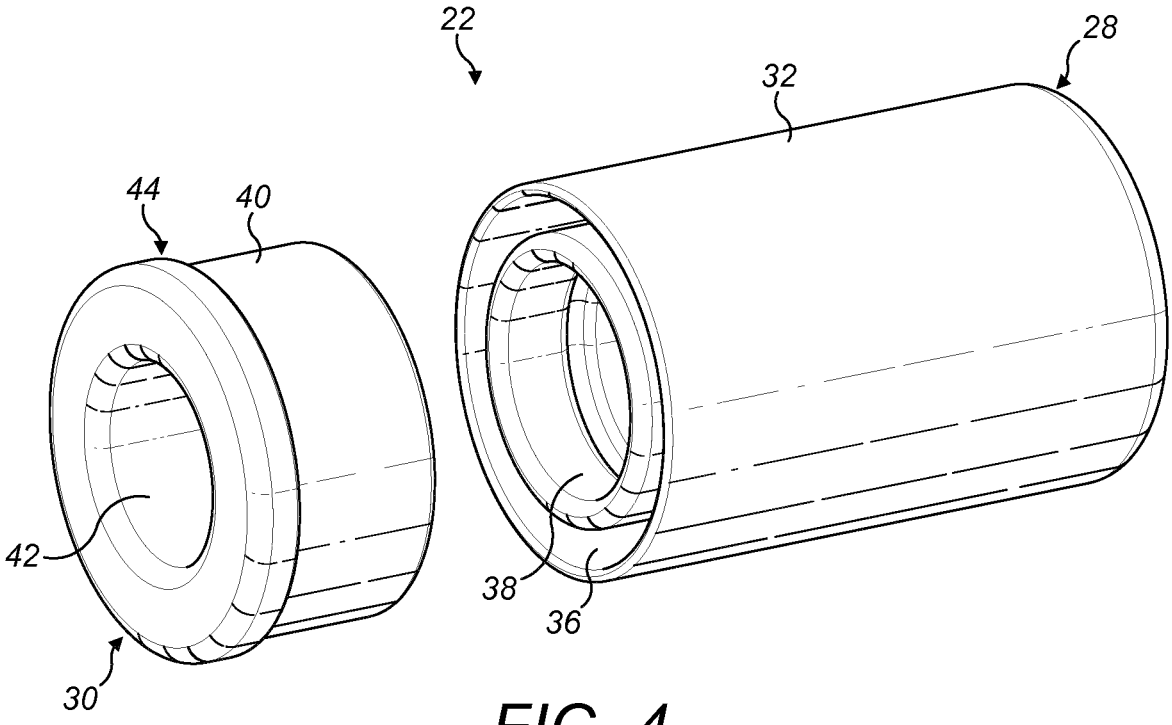
FIG. 4 shows an exploded view of the liquid delivery element of FIG. 3.

As shown in FIGS. 3 and 4, the liquid delivery element 22 comprises an annular body portion 28 and an annular stopper 30. The annular body portion 28 has a double walled structure comprising an outer wall 32 and an inner wall 34 circumscribed by the outer wall 32. The inner wall 34 defines an open longitudinal channel 38 extending between the ends of the liquid delivery element 22. The longitudinal channel 38 has a circular transverse cross section and has a diameter that corresponds to approximately 60 percent of the external diameter of the liquid delivery element 22.

The outer wall 32 and the inner wall 34 are spaced apart from each other radially to define an annular cavity 36 extending around the outside of the inner wall 34, which contains a coloured liquid comprising water. At one end of the annular body portion 28, the outer wall 32 and the inner wall 34 are integrally connected to each other to close the annular cavity 36. At the other end of the annular body portion 28, the annular cavity 36 has an opening which is sealed by means of the annular stopper 30.

The inner wall 34 has a radial thickness that is approximately 2.5 times the radial thickness of the outer wall 32. The distance at breakage of the inner wall 34 is smaller than the distance at breakage of the outer wall 32 so that the inner wall 34 breaks first upon application of a compressive force to the liquid delivery element 22.

The annular stopper 30 comprises an outer stopper wall 40 and an inner stopper wall 42 which are integrally connected to each other at one end of the annular stopper 30. The outer stopper wall 40 is inserted between the outer wall 32 and the inner wall 34 of the annular body portion 28 to seal the annular cavity 36 and the inner stopper wall 42 is provided against the inner surface of the inner wall 34 of the annular body portion 28. As shown in FIG. 3, the annular stopper 30 is inserted into the annular body portion 28 and is retained by means of a friction fit. An annular shoulder 44 is provided on the outer surface of the annular stopper 30, which abuts the edge of the outer wall 32 of the annular body portion 28 in order to prevent further movement of the annular stopper 30 into the annular body portion 28.

Before or during smoking, the consumer may squeeze the liquid delivery element 22 to activate the liquid delivery element 22 and bring about release of the liquid. The compressive force applied to the liquid delivery element 22 causes deformation of the outer wall 32 of the annular body portion 28 and an increased pressure within the annular cavity 36. At a certain level of compressive force, the increased pressure within the annular cavity 36 causes the inner wall 34 of the annular body portion 28 to crack, thereby activating the liquid delivery element 22. The breakage of the inner wall 34 of the annular body portion allows the liquid to pass from the annular cavity 36 into the longitudinal channel 38. The liquid can then flow along the longitudinal channel 38 into the upstream filter segment 18 and the downstream filter segment 20. During this activation of the liquid delivery element 22, the consumer can observe, through the aperture 26 in the tipping wrapper 16, the coloured liquid moving from the annular cavity 36 into the filter segments 18, 20.

The invention claimed is:

1. An aerosol-generating article comprising an aerosol-generating substrate and a mouthpiece secured to a downstream end of the aerosol-generating substrate, the mouthpiece comprising at least one segment of filter material and a liquid delivery element, the liquid delivery element comprising:

an upstream end and a downstream end;

a double-walled annular body portion comprising:

an inner wall defining a longitudinal channel extending through the liquid delivery element between the upstream end and the downstream end; and an outer wall integrally formed with the inner wall, the outer wall circumscribing the inner wall such that a cavity is defined between the outer wall and the inner wall, the cavity having an opening in at least one of the upstream end and the downstream end and containing a liquid; and annular sealing means inserted between the inner wall and the outer wall of the annular body portion to provide a liquid tight seal at the opening or openings of the cavity in the annular body portion;

wherein the inner wall and the outer wall of the annular body portion are configured such that the inner wall is breakable upon application of a compressive force to the liquid delivery element in a transverse direction and such that upon breakage of the inner wall the liquid is released from the cavity into the longitudinal channel.

2. An aerosol-generating article according to claim 1 wherein the distance at breakage of the inner wall is smaller than the distance at breakage of the outer wall such that the inner wall breaks preferentially upon application of a transverse compressive force to the liquid delivery element, wherein the distance at breakage of the inner wall is defined as the transverse deformation of the liquid delivery element at the point of breakage of the inner wall, and the distance at breakage of the outer wall is defined as the transverse deformation of the liquid delivery element at the point of breakage of the outer wall.

3. An aerosol-generating article according to claim 1 wherein upon application of a transverse compressive force to the liquid delivery element that equals or exceeds a maximum compressive force that the annular body portion can withstand, the inner wall breaks and the outer wall remains intact.

4. An aerosol-generating article according to claim 1 wherein the radial thickness of the inner wall of the annular body portion is greater than the radial thickness of the outer wall of the annular body portion at all positions along the length of the cavity.

5. An aerosol-generating article according to claim 4 wherein the radial thickness of the inner wall of the annular body portion is at least twice the radial thickness of the outer wall at all positions along the length of the cavity.

6. An aerosol-generating article according to claim 1 wherein one or more grooves are provided on the inner surface of the inner wall of the annular body portion, the inner wall having a reduced thickness in the one or more grooves.

7. An aerosol-generating article according to claim 1 wherein the maximum radial spacing between the outer surface of the inner wall of the annular body portion and the inner surface of outer wall of the annular body portion is less than 1 mm.

8. An aerosol-generating article according to claim 1 wherein the inner wall and the outer wall of the annular body portion are integrally connected to each other at one end of the annular body portion and wherein the opening in the cavity is provided at the other end of the annular body portion.

9. An aerosol-generating article according to claim 1 wherein the cavity contains no more than 150 microlitres of liquid.

10. An aerosol-generating article according to claim 1 wherein the annular body portion is formed from a polymeric material having an elongation at break of between 5 percent and 20 percent when measured according to the test method of ASTM D 638.

11. An aerosol-generating article according to claim 1 wherein the annular body portion is formed from a polymeric material having a flexural strength of between 80 MPa and 110 MPa when measured according to the test method of ASTM D 790.

12. An aerosol-generating article according to claim 1 wherein the annular body portion is formed from a polymeric material having a flexural modulus of between 2500 MPa and 3500 MPa when measured according to the test method of ASTM D 790.

13. An aerosol-generating article according to claim 1 wherein the force at breakage of the inner wall of the annular body portion, which corresponds to a maximum compressive force that the annular body portion can withstand before breakage of the inner wall, is between 30 Newtons and 45 Newtons.

14. An aerosol-generating article according to claim 1 wherein the annular sealing means comprises an annular stopper having an outer wall received between the outer wall and the inner wall of the annular body portion for sealing the cavity and an inner wall received against the inner surface of the inner wall of the annular body portion.

15. A liquid delivery element for use in an aerosol-generating article, the liquid delivery element comprising:

a first end and a second end;

a double-walled annular body portion comprising:

an inner wall defining a longitudinal channel extending through the liquid delivery element between the first end and the second end; and an outer wall integrally formed with the inner wall, the outer wall circumscribing the inner wall such that a cavity is defined between the outer wall and the inner wall, the cavity having an opening in at least one of the first end and the second end and containing a liquid; and annular sealing means inserted between the inner wall and the outer wall of the annular body portion to provide a liquid tight seal at the opening or openings of the cavity in the annular body portion;

wherein the inner wall and the outer wall of the annular body portion are configured such that the inner wall is breakable upon application of a compressive force to the liquid delivery element in a transverse direction and such that upon breakage of the inner wall the liquid is released from the cavity into the longitudinal channel.

* * * * *